US005420772A

United States Patent [19]

Evans

[11] Patent Number: 5,420,772

[45] Date of Patent: May 30, 1995

[54] CHANDELIER POSITIONING SYSTEM

[76] Inventor: Cliff Evans, 12 Ashford La., Newtown, Conn. 06470

[21] Appl. No.: 306,097

[22] Filed: Sep. 14, 1994

[51] Int. Cl.[6] ..... F21V 21/00

[52] U.S. Cl. ..... 362/386; 362/405; 362/387; 362/286; 248/328

[58] Field of Search ..... 362/286, 385, 386, 391, 362/405, 418, 387; 248/327, 328, 329

[56] References Cited

U.S. PATENT DOCUMENTS 3,035,804 5/1962 Wilson ..... 248/328 X
3,610,584 10/1971 Pfaff ..... 254/173
3,652,057 3/1972 Brown ..... 254/139.1
4,316,238 2/1982 Booty et al. ..... 362/147
5,105,349 4/1992 Falls et al. ..... 362/405

*Primary Examiner*—Stephen F. Husar
*Attorney, Agent, or Firm*—Robert A. Seemann

[57] ABSTRACT

A carriage which is drawn over a plurality of locations along a tightly threaded motor driven drive rod by a nut on the carriage, draws a chandelier support cable axially along the rod by way of a pulley on the carriage. The cable is wrapped on the pulley so that the vertical distance moved by the end of the cable for attachment to a chandelier is greater than the axial distance moved by the cable over the pulley. The drive rod is supported at each of the plurality of locations along the drive rod, against bowing.

18 Claims, 4 Drawing Sheets

CHANDELIER POSITIONING SYSTEM

BACKGROUND OF THE INVENTION

1. Field of the Invention

This invention pertains to a system for raising or lowering chandeliers, more specifically to an electrically operated system which unfalteringly moves the chandelier to, and retains the chandelier safely at, any height within a predetermined range.

2. Description of the Prior Art

There are a multitude of chandelier lift apparatus patented designs of various complexities and cost, for raising and lowering chandeliers with ease and safety. U.S. Pat. No. 3,610,584 patented Oct. 5, 1971, by H. C. Pfaff, Jr., describes a device having an upper section mounted to the ceiling, the device includes an electric motor having a vertical drive shaft, the lower portion of which is adapted for chain driving a vertical worm gear shaft.

The worm gear drives upon the periphery of a drum upon which is wound a flat ribbon. One end of the ribbon extends downward from the drum, and is attached to the electrical fixture for raising or lowering of the fixture by rotation of the drum.

The upper portion of the drive shaft above the motor has a brake disk. Brake jaws are spring-biased to clamp on the brake disk unless opened by a first electric solenoid.

In order to raise or lower the fixture, electrical power is applied to the solenoid and the motor so that the brake is released while the motor is driving.

A spring-biased latching mechanism on the upper section of the device moves a hook into engagement with a U-bolt on the lower section of the device when the lower section is lifted fully to the upper section. This prevents the fixture from falling should the brake fail after the fixture is fully lifted. A second electrical solenoid is attached to the hook to withdraw it from the U-bolt when electrical power is applied to the motor and first solenoid, in order to raise or lower the fixture.

U.S. Pat. No. 4,316,238, patented Feb. 16, 1982, by Booty et al. describes an apparatus for raising and lowering a light fixture with respect to a ceiling in which the frame of the apparatus is mounted.

The frame has a spring wound around a shaft and attached by one end to a carriage which is mounted on the frame for horizontal movement, so that the spring biases the carriage toward the shaft.

A combination electrical and support cable is attached by one end to the frame. Extending horizontally, the cable passes around a first pulley on the carriage, loops back horizontally, passes over a second pulley that is mounted on the frame, and suspends below the frame, a light fixture to which the cable is attached.

The carriage, being biased by the spring toward the shaft upon which the spring is wound, is pulled away from the shaft by the cable drawing upon the first pulley as the fixture is drawn down and the length of the horizontal cable loop decreases.

A horizontal piston is attached at one end to the carriage so that it is moved horizontally by the moving carriage. In one embodiment, the other end of the piston is connected to a dashpot to control the rate of descent of the fixture. The spring is designed to partially counterbalance the weight of the fixture so that the fixture falls of its own weight.

A second cable passing over a pulley which is coaxial with the spring shaft is attached at one end to the carriage and has a knob at the other end for grasping and pulling down to draw the fixture back up by drawing the carriage toward the spring shaft. A bead on the second cable engages a catch on the frame when the knob is drawn down far enough to bring the light fixture to the uppermost position. The bead and catch keep the light fixture from moving down until, to lower the fixture, the second cable is pulled laterally until the bead escapes the catch, allowing the second cable and knob to raise up.

In another embodiment, there is no second cable, and no dashpot. The fixture weighs less than the bias force from the spring and does not fall of its own accord but has a finger loop by which it can be drawn down against the bias of the spring.

A transverse pin through the piston engages a clip when the piston is moved horizontally away from the spring shaft by the carriage as the fixture moves to the lowered position. The clip prevents the fixture from moving back up, but it can be disengaged by pulling the fixture further down a bit. Freeing the piston allows the carriage to move toward the spring shaft and the fixture to move toward the ceiling.

In another embodiment, instead of a dashpot on the piston to control the rate of descent of the fixture, a frictional drag mechanism is incorporated on the spring shaft.

A motorized chandelier lift system for raising and lowering a light fixture between a raised position adjacent to a ceiling and a lowered position distant from the ceiling, described in U.S. Pat. No. 5,105,349, patented Apr. 14, 1992, by Falls et al., has a hoist mechanism mounted above the ceiling from which the chandelier hangs. The hoist mechanism includes a drive motor having a drive shaft and a take-up shaft directly coupled to the drive shaft. A single hoist cable is attached at one end to the take up shaft for being wound on the take up shaft, and at the other end to a junction box on the light fixture. A junction box on the ceiling includes a set of contacts for supplying electrical power to the light fixture. The junction box on the light fixture includes a set of electrical contacts for receiving electricity from the ceiling junction box by contacting the electrical contacts in the ceiling junction box when the fixture is in the second position.

The light fixture is raised and lowered by winding and unwinding the hoist cable on the take-up shaft. The motor or the cable winder portion of the hoist mechanism may include a self-activating automatic brake.

SUMMARY OF THE INVENTION

It is one object of the invention to provide a chandelier raising and lowering system that can move a chandelier to any height within two predetermined limits.

It is another object that the chandelier raising and lowering system be inexpensive to manufacture.

It is another object that the system occupies a small space on a ceiling relative to the range of height between the two predetermined limits.

It is another object that the system be failproof, in that the chandelier cannot fall absent absolute breakage of a component of the system such as a cable or shaft.

It is another object that the system can be made, by remote control, to raise or lower the chandelier.

Other objects and advantages will become apparent to a reader from the ensuing description of the invention.

A motor and a threaded drive rod having an axis are mounted on a frame for mounting on a ceiling. Means for rotating the threaded drive rod is connected to the motor for driving the rod by the motor.

Carriage means is mounted on the drive rod and connected to the threads on the rod for being moved by the threads, axially over a plurality of locations along a substantial length of a threaded portion of the drive rod.

The carriage includes means for holding a cable for axially moving the cable by the carriage. One end of the cable is for attaching to a chandelier. Preferably, the means for moving the cable includes pulley means mounted on the carriage.

The frame comprises means for supporting at each of the plurality of locations of the carriage along the drive rod, the drive rod against bowing. In a preferred embodiment, the means for supporting the drive rod comprises channel means closely fitting the drive rod along a substantial length of the threaded portion of the drive rod. In another embodiment, the means for supporting the drive rod comprises bar means extending axially along a substantial length of the threaded portion of the drive rod, and being slidably attached to the carriage means.

The cable is preferably wrapped over the pulley means on the carriage so that the end of the cable for the chandelier moves a longer distance than the distance of axial movement of the cable by the pulley means on the carriage when the cable is being moved by the carriage. The other end of the cable is preferably attached to the frame.

The number of threads per inch of the threaded drive rod is selected so that axial force on the threads from the carriage does not force said threaded drive rod into rotation.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
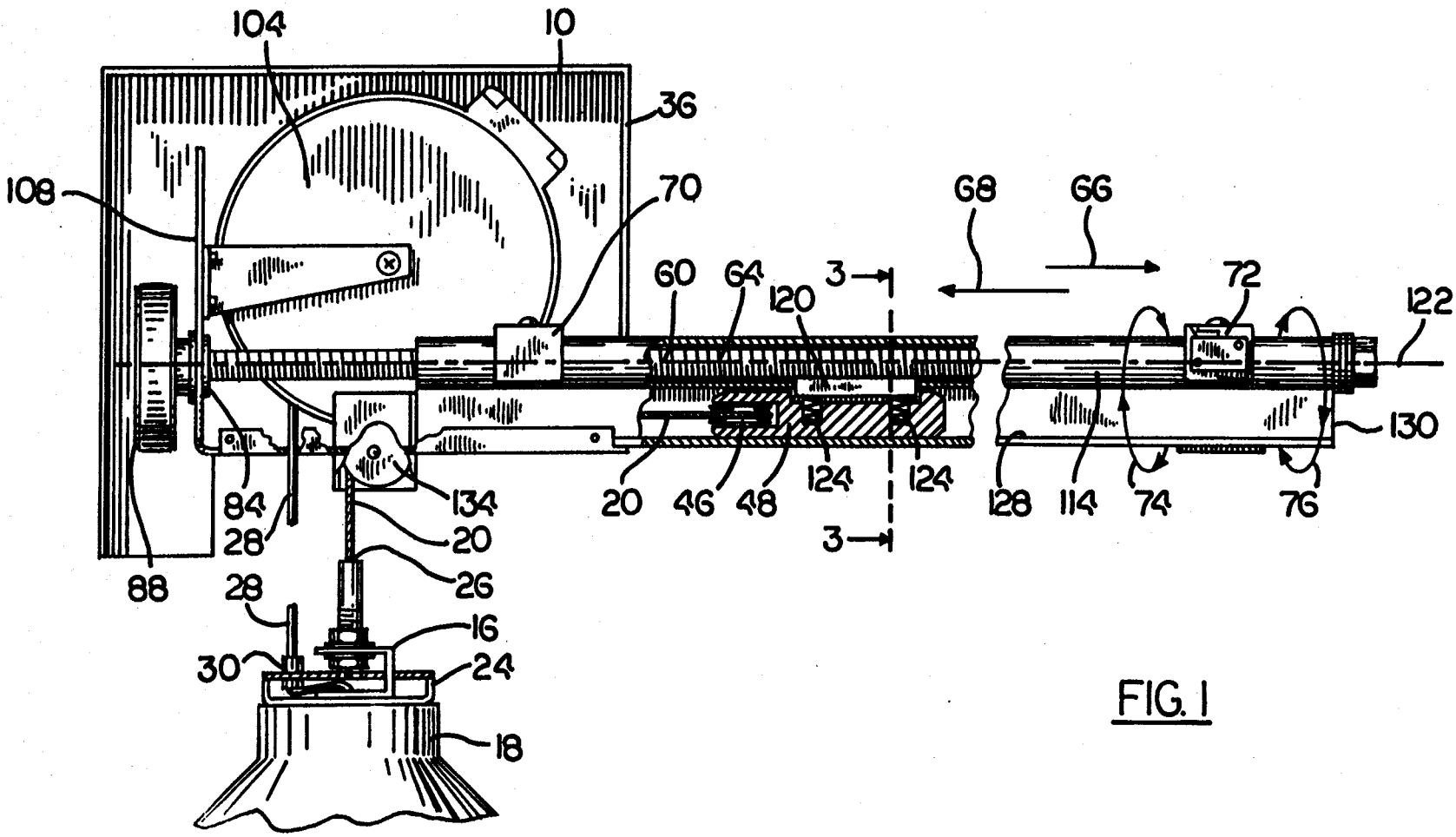
FIG. 1 is a front view of a system of the present invention.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 2:
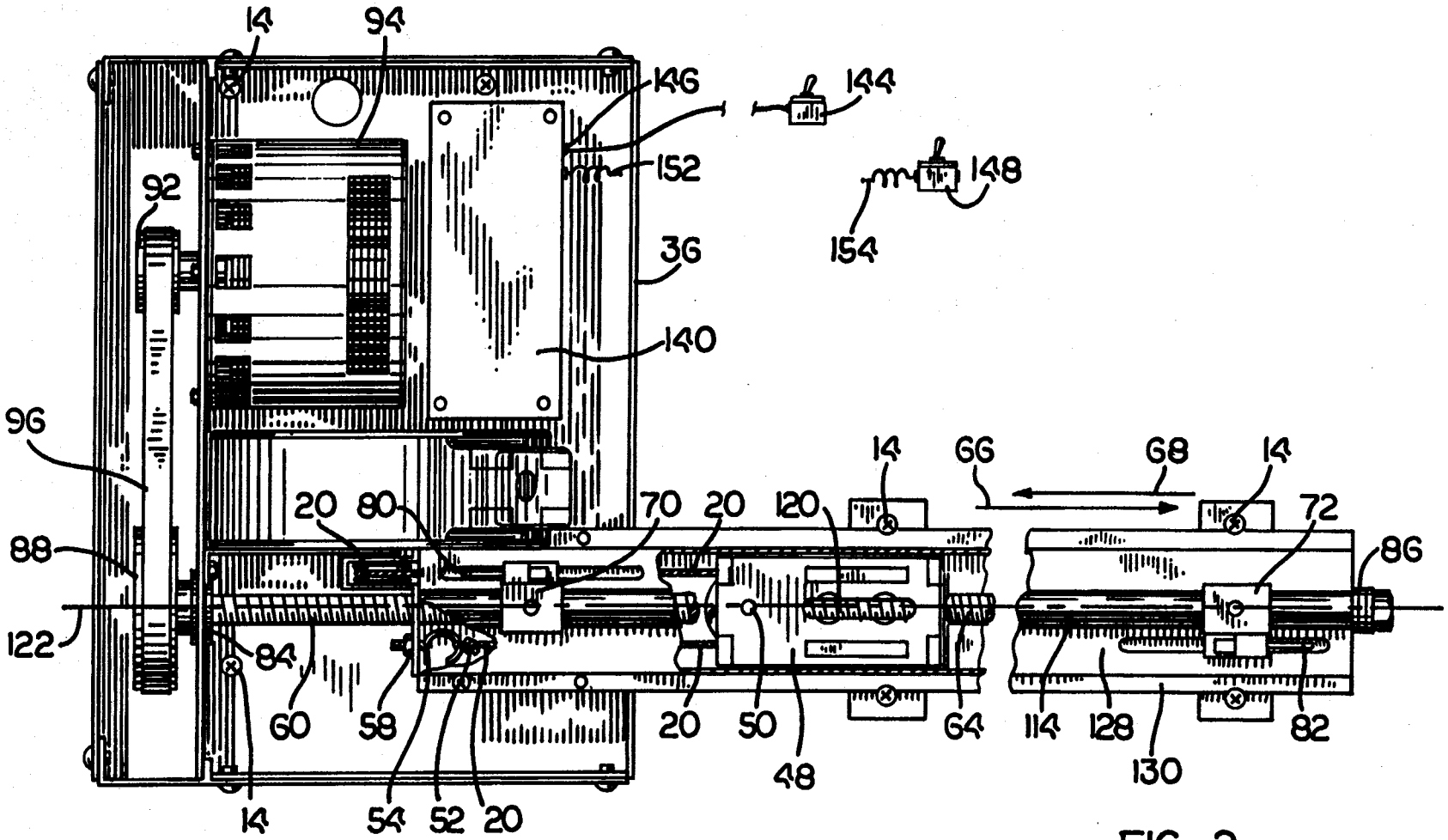
FIG. 2 is a top view of the system of FIG. 1.
Figure 3:
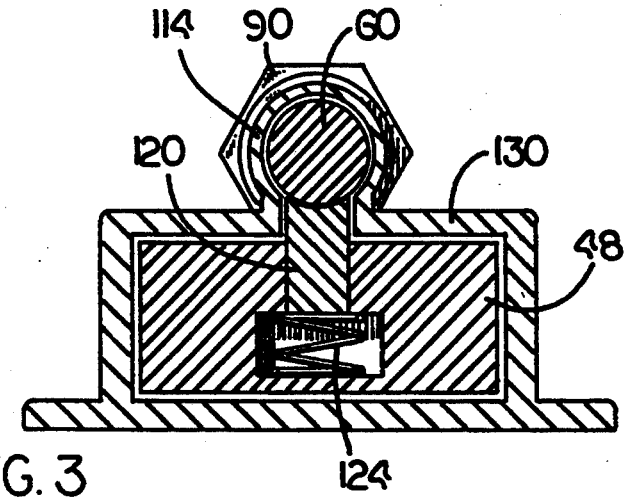
FIG. 3 is a section view of FIG. 1 taken along 3—3.

Referring to FIGS. 1, 2, and 3, chandelier lift system 10, which is attached to a ceiling by screws 14, supports bracket 16 of chandelier 18 by end 26 of stranded steel cable 20. Bracket 16 is joined with electric junction box 24, to which is attached electric lamp cord 28 via strain relief 30.

Cable 20 passes over pulley 34 which vertically supports the chandelier load. Pulley 34 is attached to housing 36 by bracket 38. Cable 20 continues horizontally until it loops around pulley 46 which is mounted on carriage 48, and fastened there by spring pin 50. The cable passes horizontally to hook 54, and attaches by end 52 to the hook which is attached to housing 36 by nut 58.

Carriage 48 is securely and slidably mated with threaded drive rod 60 so that the carriage is moved forward and back as shown by direction arrows 66 and 68 respectively, along rod 60 by threads 64 as rod 60 rotates clockwise and counterclockwise as shown by direction arrows 74 and 76 respectively.

Drive rod 60 is rotated on flange bearing 84 and needle thrust bearing 86, by pulley 88. Needle thrust bearing 86 is secured to the housing by nut 90. Pulley 88 is driven by motor shaft pulley 92 of motor 94 by way of drive belt 96. A drive chain may be used instead of the belt.

Electric lamp cord 28 is rolled up on spring loaded reel 104 which is mounted on frame 36 by bracket 108.

Limit switches 70 and 72 are preferably wired to stop motor 94 when carriage 48 reaches one of the switches. They may be wired, however, to reverse the motor when a limit switch is reached. The axial limits of travel are set by positioning the switch so that contact fingers 80 and 82 are contacted by carriage 48 at the back and forward predetermined limits of axial travel of the carriage.

In a preferred embodiment of the invention, pulley 88 is 3" in diameter, pulley 92 is 1½" in diameter, the motor is ⅓ HP AC 115 V 1500 RPM rated, and the threaded drive rod is ½-10 Acme. Pulleys 92 and 88 slow motion provided by motor 94, and increase torque to threaded drive rod 60.

Threaded drive rod 60 provides increased mechanical advantage, and slows horizontal speed of the carriage along the rod relative to the rotational speed of motor 94. This is partially countered by the mechanical disadvantage of cable 20 over pulley 46, which permits carriage travel to be half of the vertical lifting distance of end 26 of cable 20, and provides for use of a short drive rod relative to the vertical lifting distance. For example, a five foot vertical travel distance by end 26 of cable 20 may be driven by a two and one half foot length of carriage drive thread on rod 60. In like manner additional pulleys may be used to further decrease the ratio of length of carriage drive thread to vertical travel distance of cable end 26.

Threaded drive rod 60 rotates within drive rod channel 114 which closely fits the rod, supporting the rod at each location of the carriage against the rod bending or bowing. Carriage 48 includes threaded carriage nut 120 which is forced into threads 64, radially against rod 60, or normal to axis 122 of rotation of threaded drive rod 60, by carriage nut springs 124. Radial support for the radial force of carriage nut 120 against rod 60 is provided by wall 128 of channel frame 130. Carriage 48 bears against wall 128 under the counter thrust of springs 124.

The combination of channel 114 supporting threaded drive rod 60 against bending, and carriage nut 120 supported against the rod by channel frame 130, unalterably locks carriage nut 120 into threads 64 of drive rod 60 so that lengthwise slippage between the carriage and the threaded rod is prevented.

The number of threads per inch of the threaded drive rod is selected so that axial force on the threads between the carriage nut and the rod will not force the rod to rotate. This resistance to self-rotation under load, and the locking of the carriage nut into the threads of the drive rod, prevents accidental falling of the chandelier save for absolute breaking of a component such as the cable or pulley 46.

The limits of axial travel of the carriage may be changed by shifting the limit switches axially and fastening each to channel 114 of channel frame 130 by a screw 134 through the top of each switch.

Control circuit box 140, mounted on base plate 142, contains circuitry designed according to engineering practice known to the art, to reversibly operate motor 94 by way of remote switch 144 that is connected to box 140 by way of plug 146. Control box 140 also is designed to respond to radio control from remote transmitter switch 148 by way of antennas 152 and 154. In like manner, infrared or other remote control may be provided by control circuit box 140.

Motor 94, reel 104, and channel frame 130 are mounted on base plate 142. Chandelier lift system 10 is attached to a ceiling preferably by screws through base plate 142, and screws 14 through channel frame 130.

Figure 5:
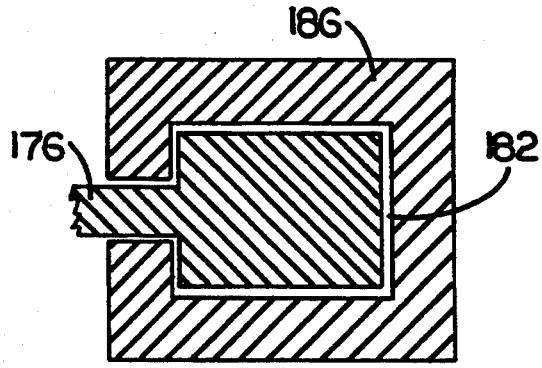
FIG. 5 is a section view of FIG. 4, taken along 5—5.
Figure 4:
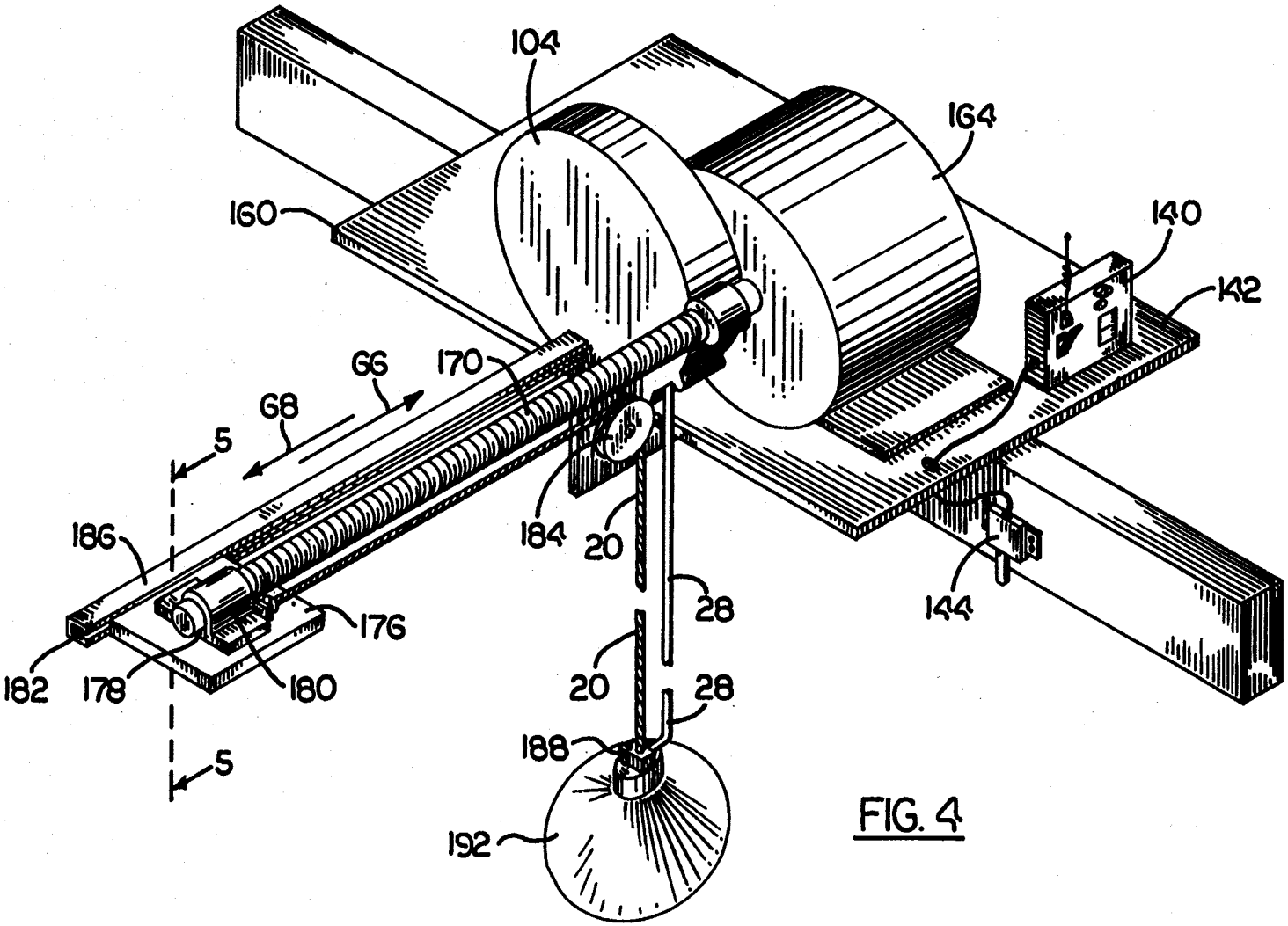
FIG. 4 is a perspective view of a system of the present invention.

Referring now to FIGS. 4 and 5, chandelier lift system 160 includes motor 164 directly driving threaded drive rod 170. Carriage 176 is slidably fastened around threaded rod 170 by threaded nut portion 178 and capture bracket 180. Bowing of threaded rod 170 is resisted by bar track 186 which slidably holds carriage 176 in a T shaped track 182. The threaded rod is supported at each position of carriage 176 along rod 170 by track 182, by the track being joined with the rod at that location by the carriage.

Cable 20 is attached to carriage 176, passes over pulley 184, and is attached to chandelier support bracket 188 for chandelier 192.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A system for vertically positioning a chandelier relative to a ceiling, said apparatus comprising:

a frame for mounting on a ceiling, motor means mounted on said frame, a threaded drive rod having an axis and being mounted on said frame for rotating about said axis, means for rotating said drive rod, connected to said motor and said drive rod for driving said rod by said motor, carriage means, mounted on said drive rod and connected to the threads on said drive rod for being moved axially over a plurality of locations along a substantial length of a threaded portion of said drive rod by said threads on said drive rod, cable means having a first end and a second end, means on said carriage means for holding said cable means for axially moving said cable means by said carriage means, said second end of said cable means being for attaching to a chandelier, means on said frame for supporting said cable means for hanging a chandelier by said second end when said frame is attached to a ceiling.

2. The system of claim 1, further comprising:

said frame comprising means for supporting, at each of said plurality of locations of said carriage along said drive rod, said drive rod against bowing.

3. The system of claim 2, further comprising:

said means for supporting said drive rod comprising channel means closely fitting said drive rod along a substantial length of the threaded portion of said drive rod.

4. The system of claim 2, further comprising:

said means for supporting said drive rod comprising bar means extending axially along a substantial length of the threaded portion of said drive rod, and being slidably attached to said carriage means.

5. The system of claim 3, further comprising:

said means on said carriage for axially moving said cable means comprising pulley means on said carriage.

6. The system of claim 5, further comprising:

said first end of said cable being attached to said frame.

7. The system of claim 6, further comprising:

said cable being wrapped over said pulley means so that said second end of said cable moves a longer distance than the distance of axial movement of said cable by said pulley means on said carriage when said cable is being moved by said carriage.

8. The system of claim 7, further comprising:

the number of threads per inch of said threaded drive rod being selected so that axial force on said threads from said carriage does not force said threaded drive rod into rotation.

9. The system of claim 8, further comprising:

spring loaded reel means for storing electrical wire, attached to said frame.

10. The system of claim 1, further comprising:

said means on said carriage for axially moving said cable means comprising pulley means on said carriage.

11. The system of claim 10, further comprising:

said first end of said cable being attached to said frame.

12. The system of claim 11, further comprising:

said cable being wrapped over said pulley means so that said second end of said cable moves a longer distance than the distance of axial movement of said cable by said pulley means on said carriage when said cable is being moved by said carriage.

13. The system of claim 12, further comprising:

the number of threads per inch of said threaded drive rod being selected so that axial force on said threads from said carriage does not force said threaded drive rod into rotation.

14. The system of claim 1, further comprising:

said connection of said carriage means to the threads on said drive rod comprising a threaded element, mounted on said carriage for movement relative to said carriage that is generally normal to said axis.

15. The system of claim 14, further comprising:

resilient means on said carriage for biasing said threaded element against said threads on said drive rod.

16. The system of claim 15, further comprising:

means bearing against said carriage for supporting said carriage normal to said axis along a substantial length of the threaded portion of said drive rod, attached to said frame, and being generally parallel to said axis.

17. The system of claim 1, further comprising:

means bearing against said carriage for supporting said carriage normal to said axis along a substantial length of the threaded portion of said drive rod, attached to said frame, and being generally parallel to said axis.

18. The system of claim 3, further comprising:

said connection of said carriage means to the threads on said drive rod comprising a threaded element, mounted on said carriage for movement relative to said carriage that is generally normal to said axis.

* * * * *